US005615427A

United States Patent [19]

Huang

[11] Patent Number: 5,615,427

[45] Date of Patent: Apr. 1, 1997

[54] FOLDABLE PLAYYARD

[76] Inventor: Li-chu C. Huang, No. 9, Alley 2, Lane 606, Sec. 2, Po Ai Rd., Chia Yi City, Taiwan

[21] Appl. No.: 563,643

[22] Filed: Nov. 28, 1995

[51] Int. Cl.[6] ..... A47D 7/00; A47D 13/06

[52] U.S. Cl. ..... 5/99.1; 5/98.1

[58] Field of Search ..... 5/93.1, 99.1, 98.1, 5/207, 208; 256/25

[56] References Cited

U.S. PATENT DOCUMENTS

| | | | |
|---|---|---|---|
| 5,239,714 | 8/1993 | Huang | 5/99.1 |
| 5,349,709 | 9/1994 | Cheng | 5/93.1 |
| 5,497,517 | 3/1996 | Wang | 5/99.1 |
| 5,504,951 | 4/1996 | Yeh | 5/99.1 |

*Primary Examiner*—Alexander Grosz
*Attorney, Agent, or Firm*—Ross, Clapp, Korn & Montgomery, L.L.P.

[57] ABSTRACT

A foldable playyard combined with an outer playyard frame assembly and an inner playyard frame assembly is disclosed. The outer playyard comprises an essentially rectangular upper support composed of four pairs of rail sections each centrally coupled by a switch unit, each pair of rail sections being pivotably connected to a respective corner bracket provided at four corners of the upper support, a lower support respectively engaged with four vertical rails at a lower end. The lower support includes four legs, each for receiving a corresponding vertical rail, four tilting rails sections each pivotably coupled to one of the legs at one end thereof, two pairs of curved L-shaped rail sections, each respectively coupled with the other ends of two adjacent tilting rails by a hinge and pivotably attached to each other at a different end and two posts each disposed under one of the hinges and supporting the corresponding hinge, providing a stable lower support structure. The inner playyard has four corner bearers each releasably gripped to a corresponding corner bracket and four vertical short rails each integrally formed beneath a corresponding corner bearer to provide a height-adjustable structure.

6 Claims, 9 Drawing Sheets

FOLDABLE PLAYYARD

FIELD OF THE INVENTION

The present invention relates to a foldable playyard, more particularly to a foldable playyard combined with an outer playyard and an inner playyard to achieve height adjustment and to a foldable playyard having a switch unit and an improved lower support to obtain a readily-foldable and stable structure.

BACKGROUND OF THE INVENTION

Various attempts have been made to provide a foldable playyard for safe occupation by a child. Conventional foldable playyards are made of boards and generally comprise a pair of pivot hinges each disposed midway along a cross rail section thereof to achieve a fold. Though this type playyard can be folded when stored, it still has a large volume after being folded which is inconvenient for those families living in a limited space. An improved foldable playyard is disclosed in Taiwan Pat. No. 83,202,736. This type of the foldable playyard is combined with an upper support, a lower support and four vertical rail sections. Two safety catch units and fastener units are provided to connect one corner bracket to another one close thereto. Though this type of foldable playyard reduces the volume after being folded, there still exist several drawbacks. Firstly, folding is accomplished by a user pressing the fastener unit and rotating all the rail sections, requiring a large force to operate. Secondly, due to a large volume of the playyard, the lower support is only supported by two posts which is inadequate in preventing the playyard from moving or shaking when used. Thirdly, this type of playyard is not designed with height adjustment so that it can be adapted in accordance with the growth of a child.

The present invention therefore is aimed to provide an improved foldable playyard to mitigate and/or obviate the aforementioned problems.

SUMMARY OF THE INVENTION

One object of the present invention is to provide an improved foldable playyard having a switch unit centrally coupling a pair of rail sections of the upper support in a manner similar to that of a press key to achieve readily a simple folding of the playyard.

Another object of the present invention is to provide an improved foldable playyard combined with an outer playyard and an inner playyard to achieve height adjustment of the playyard.

Still another object of the present invention is to provide an improved foldable playyard designed with two pairs of intercross curved L-shaped rail sections to increase the strength of the playyard.

In accordance with one aspect of the present invention, the foldable playyard comprises an outer playyard frame assembly and an inner playyard frame assembly. The outer frame assembly includes a first essentially rectangular upper support composed of four pairs of rail sections each centrally coupled by a switch unit, each pair of rail sections being pivotably connected to a respective corner bracket provided at four corners of the upper support, four vertical rails each fixedly connected to a corresponding corner bracket at an upper end and a lower support connected with the four vertical rails at a lower end of the vertical rails. The inner frame assembly includes a second essentially rectangular upper support composed of four pairs of hingedly coupled rail sections with each pair further pivotably connected to a respective corner bearer provided at four corners of the second upper support, each of said corner bearers releasably gripped to a corresponding corner bracket; and four vertical short rails each integrally formed beneath a corresponding corner bearer.

In accordance with another aspect of the present invention, the lower support of the outer playyard includes four legs each for receiving a corresponding vertical rail, four tilting rails sections each pivotably coupled to one of the legs at one end thereof, two pairs of curved L-shaped rail sections, each respectively coupled with the other ends of two adjacent tilting rails by a hinge and pivotably attached to each other at a different end; and two posts each supporting one of the hinges, whereby to form a stable lower support structure.

In accordance with a further aspect of the present invention, the switch unit of the upper support has a first member having a first tube integrally extending from a first eccentric strap having an opening for connection with one of each pair of the rail sections, defining a convex edge around the eccentric strap and a through-hole at a center for a screw; a second member having a second tube integrally extending from an eccentric strap for connection with the other of each pair of the rail sections and defining a notch at a periphery proximate to the connection of the tube to the eccentric strap and a hole at a center thereof for a screw; a third member sandwiched between the first and second members, defining a notch at a top thereof and an elongate hole for screw and forming a block correspond to the opening of the first member and a press-portion at the bottom thereof; and a spring compressed between the notch of the third member and a periphery formed by the combination of the first and the second members so as to provide a press-key effect.

Other objects, advantages, and novel features of the invention will become more apparent from the following detailed description when taken in conjunction with the accompanying drawings.

DESCRIPTION OF THE PREFERRED EMBODIMENT

Figure 1:
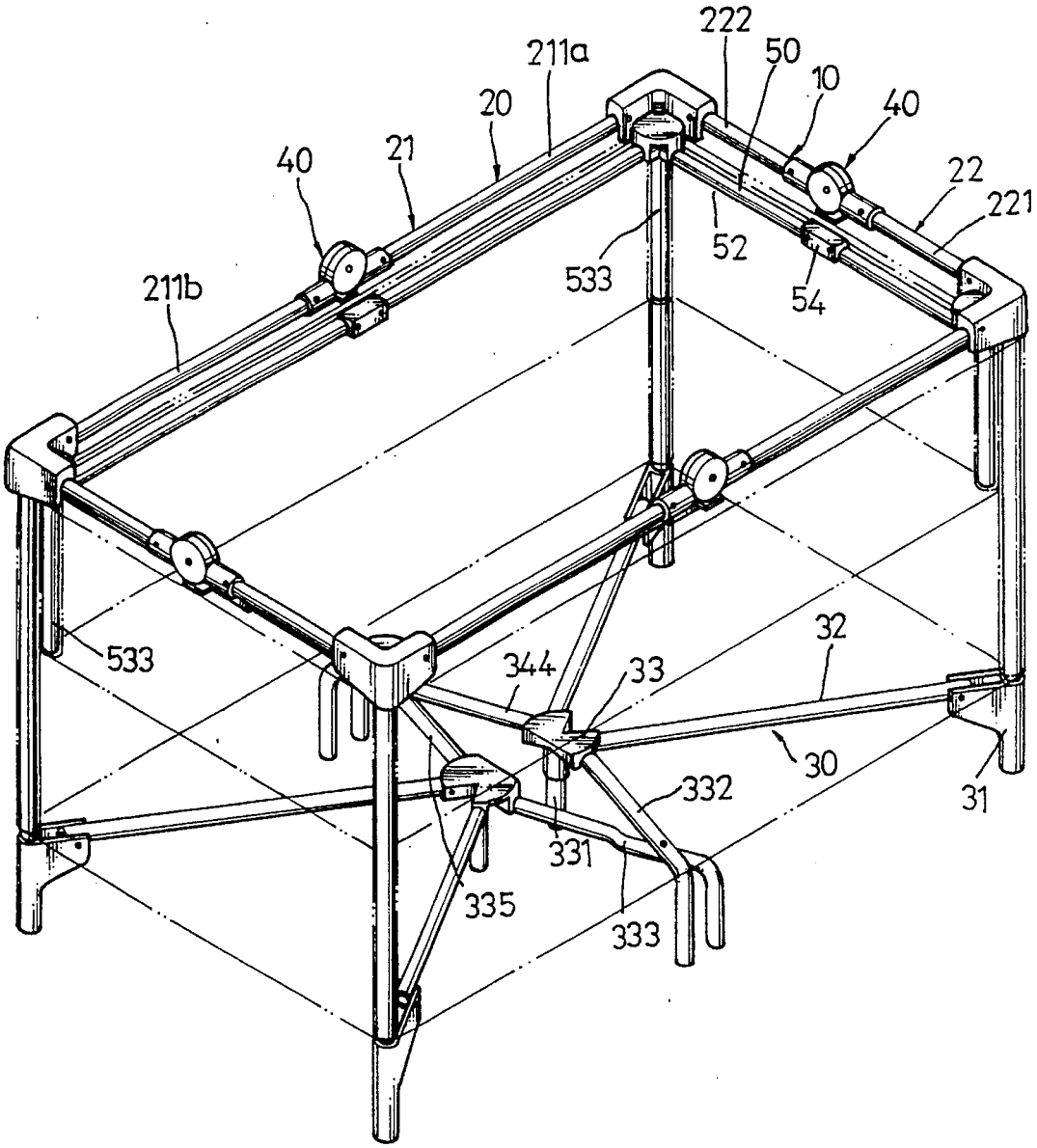
FIG. 1 is a perspective view of a preferred embodiment of the foldable playyard showing a combination of an outer playyard frame assembly and an inner playyard frame assembly in accordance with the present invention.
Figure 2:
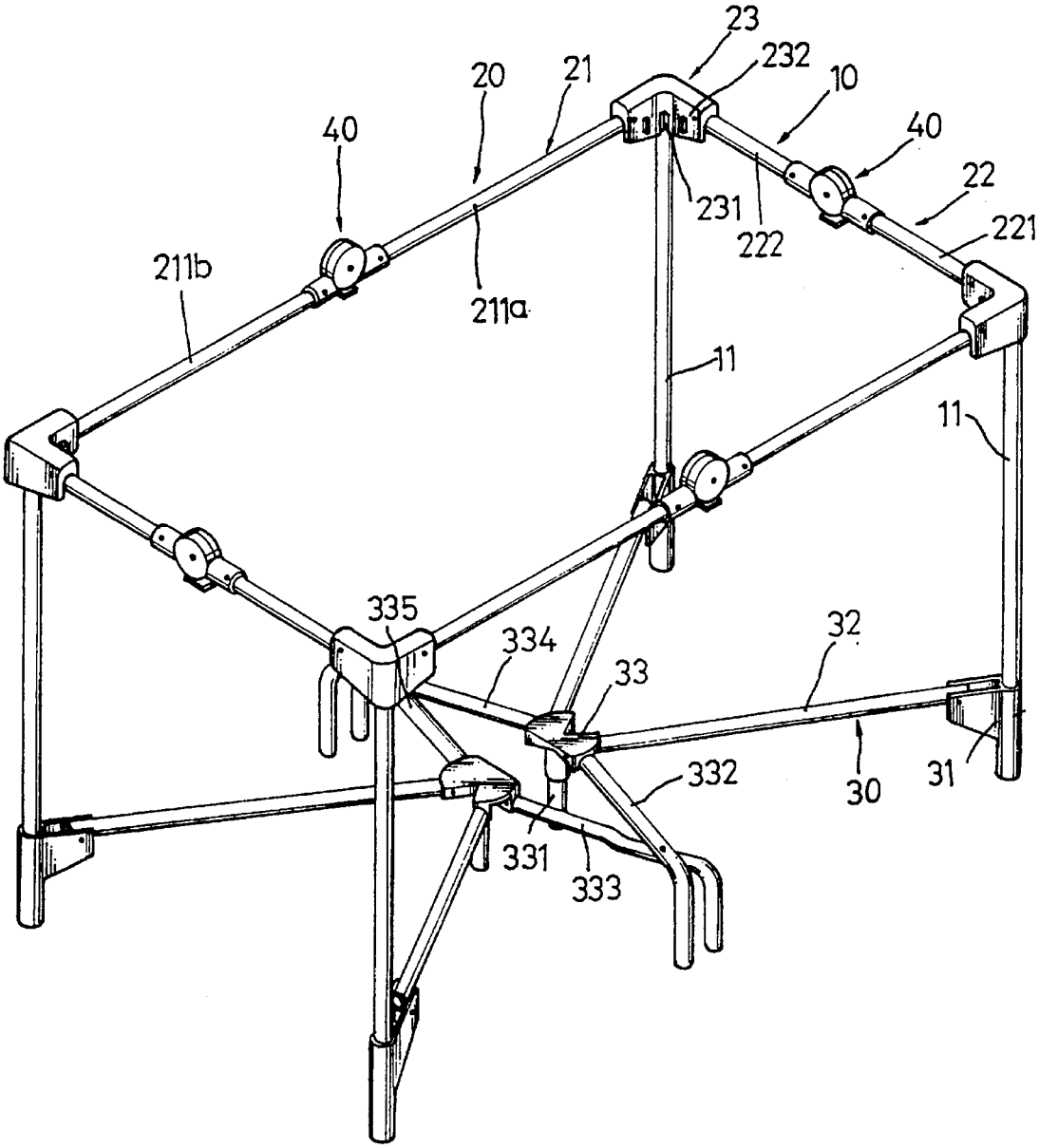
FIG. 2 is a perspective view of a preferred embodiment of the foldable playyard showing an outer playyard frame assembly in accordance with the present invention.

Referring to FIG. 1, a foldable playyard in accordance with the present invention comprises an outer playyard frame assembly 10 and an inner playyard frame assembly 50. The structure of the outer playyard frame assembly 10 can be best understood by referring to the accompanying FIG. 2. It can be seen that the outer playyard frame assembly 10 includes a first essentially rectangular upper support 20 composed of four pairs of rail sections 21 and 22 each centrally coupled by a switch unit 40, each pair of rail sections 21 and 22 being pivotably connected to a respective corner bracket 23 provided at four corners of the upper support 20; four vertical rails 11 each fixedly connected to a corresponding corner bracket 23 at an upper end; and a lower support 30 connected with the four vertical rails 11 at a lower end of the vertical rails 11.

A special aspect of the present invention is characterized by the improved lower support 30. As demonstrated, the lower support 30 of the outer playyard frame assembly 10 includes four legs 31 each receiving a corresponding vertical rail 11, four tilting rail sections 32 each pivotably coupled to one of the legs 31 at one end thereof, two pairs of curved L-shaped rail sections 332 and 334, 333 and 335, each respectively coupled with the other ends of two adjacent tilting rails 32 by a hinge 33 and pivotably attached to each other at a different end; and two posts 331 each supporting one of the hinges 33, to form a stable lower support structure.

Figure 3:
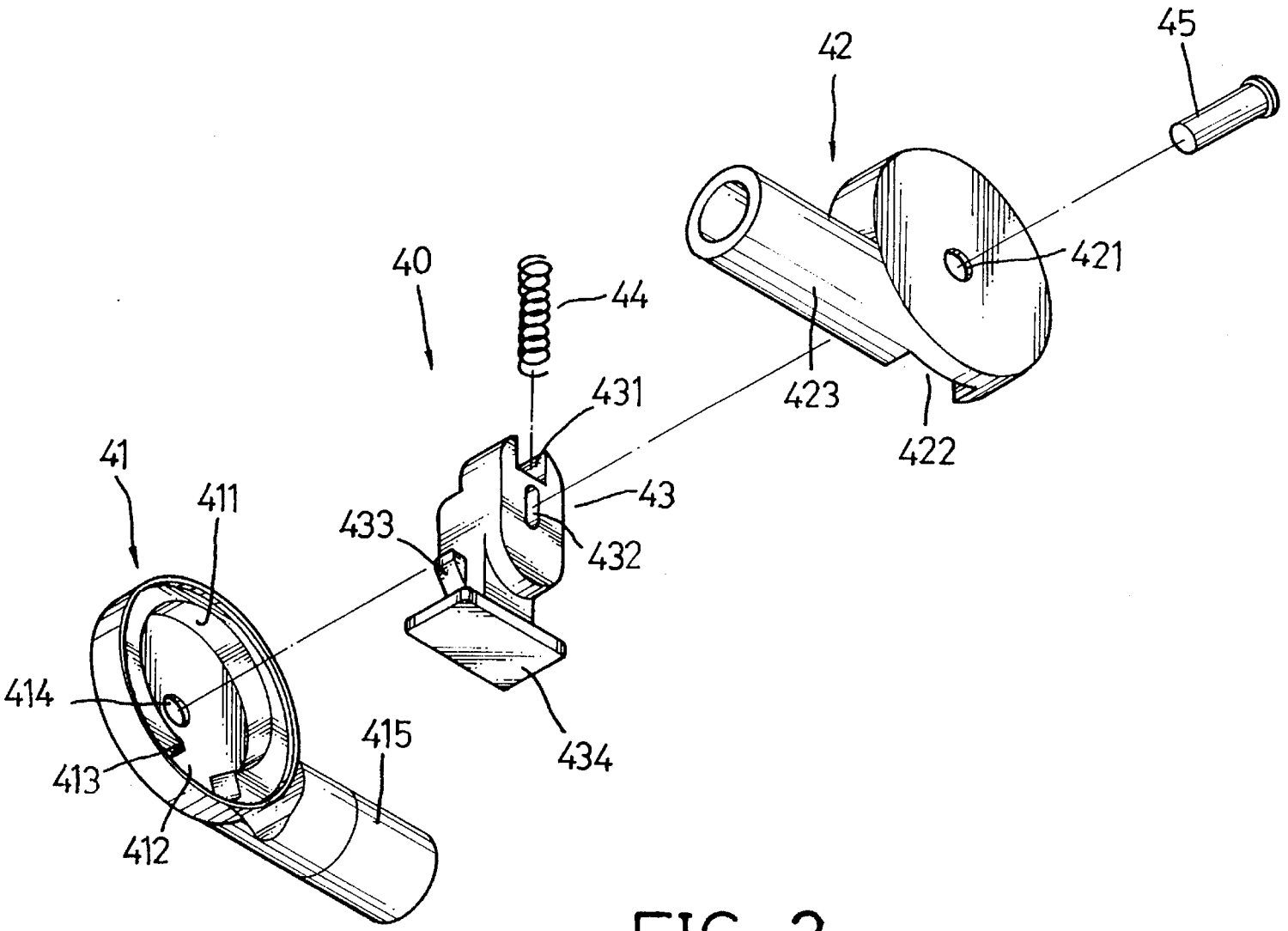
FIG. 3 is an exploded view of a switch unit of the foldable playyard in accordance with the present invention.

FIG. 3 is an exploded view of a switch unit of the foldable playyard in accordance with the present invention. As shown in FIG. 3, the switch unit 40 is designed with a first member 41 having a first tube 415 for connection with one rail 211*a* of each pair of the rail sections integrally extending from a first eccentric strap 411 having an opening 412, defining a convex edge 413 around the eccentric strap 411 and a through-hole 414 at a center for receiving a screw; a second member 42 having a second tube 423 integrally extending from an eccentric strap (not shown) for connection with the other rail 211*b* of each pair of the rail sections 21 and defining a notch 422 at a periphery proximate the connection of the tube 423 to the eccentric strap and a hole 421 at a center thereof; a third member 43 sandwiched between the first and second member 41 and 42, defining a notch 431 at a top thereof and an elongate hole 432 at a center thereof and forming a block 433 corresponding to the opening 412 of the first member 41 and a press-portion 434 at the bottom thereof; and a spring 44 compressed between the gap 431 of the third member 43 and a periphery formed by combination of the first and the second members 41 and 42 so as to provide a press-key effect. The same switch unit 40 is used in the other pair of the rail sections 22 for connecting rail 221 to the rail 222.

Figure 4:
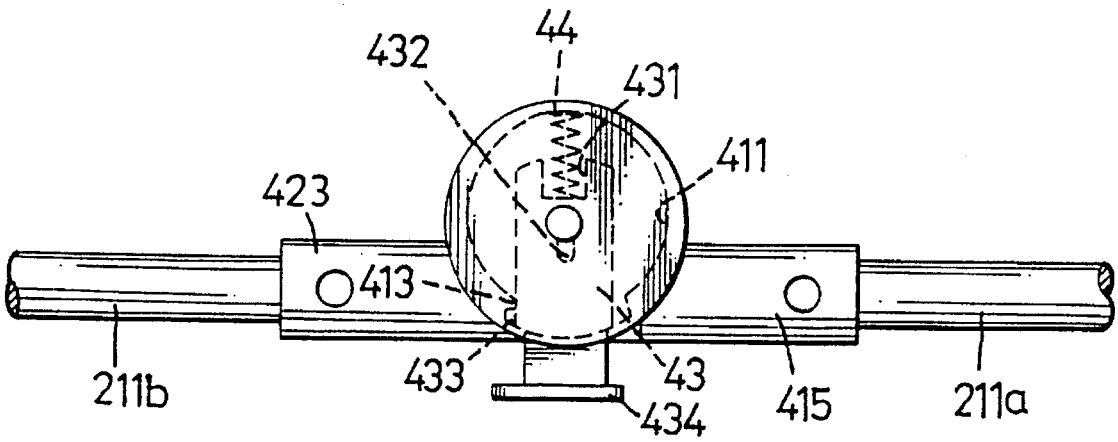
FIG. 4 is a schematic view of the switch unit when it is expanded in accordance with this invention.
Figure 5:
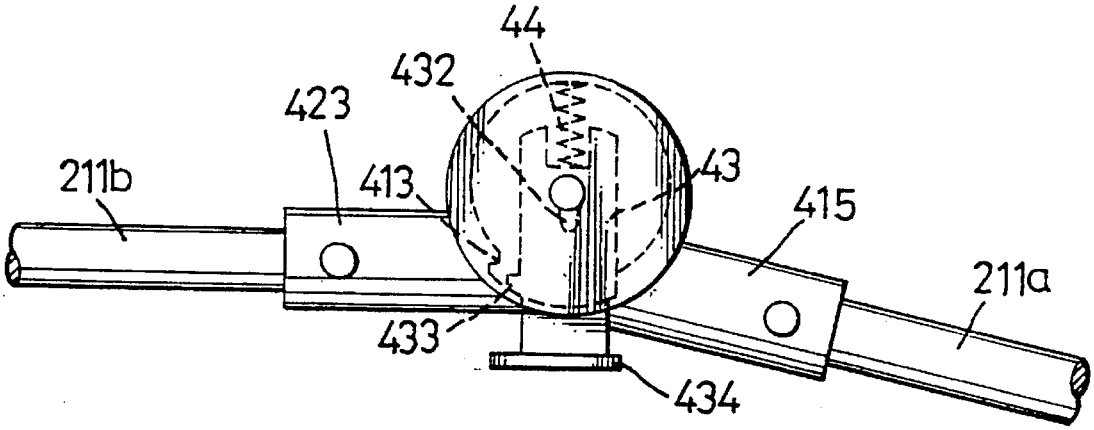
FIG. 5 is a schematic view showing a first stage of operation of the switch unit in accordance with this invention.
Figure 6:
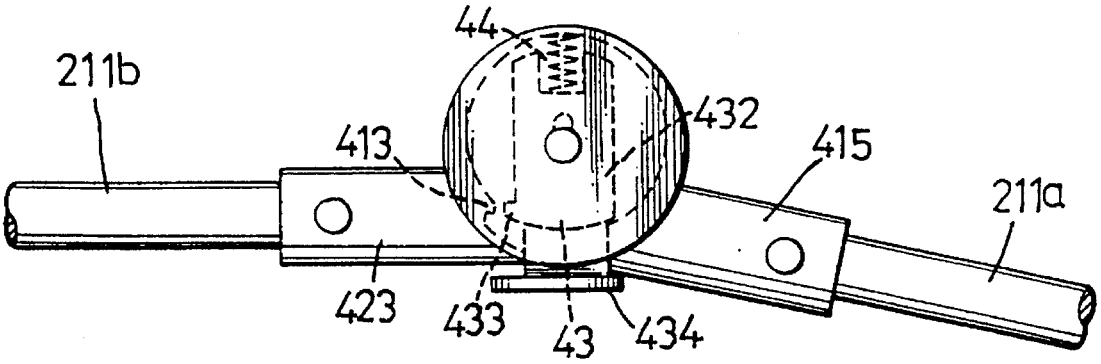
FIG. 6 is a schematic view showing a second stage of operation of the switch unit in accordance with this invention.
Figure 7:
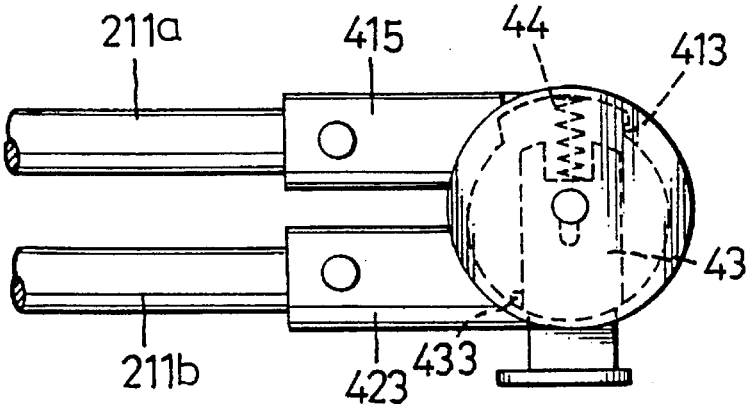
FIG. 7 is a schematic view showing the switch unit being folded in accordance with this invention.

The operation of the switch unit 40 can be understood by referring to FIGS. 4 to 7. In FIG. 4, there is shown a schematic view of the switch unit 40 being expanded in accordance with this invention. The first member 41, (FIG.3) the second member 42, the third member 43 are pivotably engaged by a trunnion 45. The pair of the rail sections 211*a* and 211*b* from a straight line the block 433 bayonet locks the convex edge 413 at the opening 412 and the spring 44 is released between the notch 431 and the periphery formed by combination of the first and the second members 41 and 42, to enable the first and second members 41 and 42 engaging the rail section 211*a* and 211*b* to be connected without generating a differential motion. In FIG. 5, there is shown a first stage of operation of the switch unit 40 in accordance with this invention. If the pair of the rail sections 211*a* and 211*b* is to be folded, a user can push the whole switch unit 40 upwardly to enable the first and second members 41 and 42 to move relatively, which causes the block 433 of the third member 43 to be released from the convex edge 413. The user then can push the press-portion 434 upwardly to enable the relative position of the block 433 and the convex edge 413 to be changed (as shown in FIG. 6) and hereafter pull the whole switch unit 40 downwardly and rotate one of the pair of rail sections 211*a* or 211*b* (as shown in FIG. 7) in order to fold the pair of rail sections. Since the switch unit 40 is provided for a two-stage operation, the outer playyard frame assembly thus achieves a readily-expanded and readily-foldable, stable support.

Figure 8:
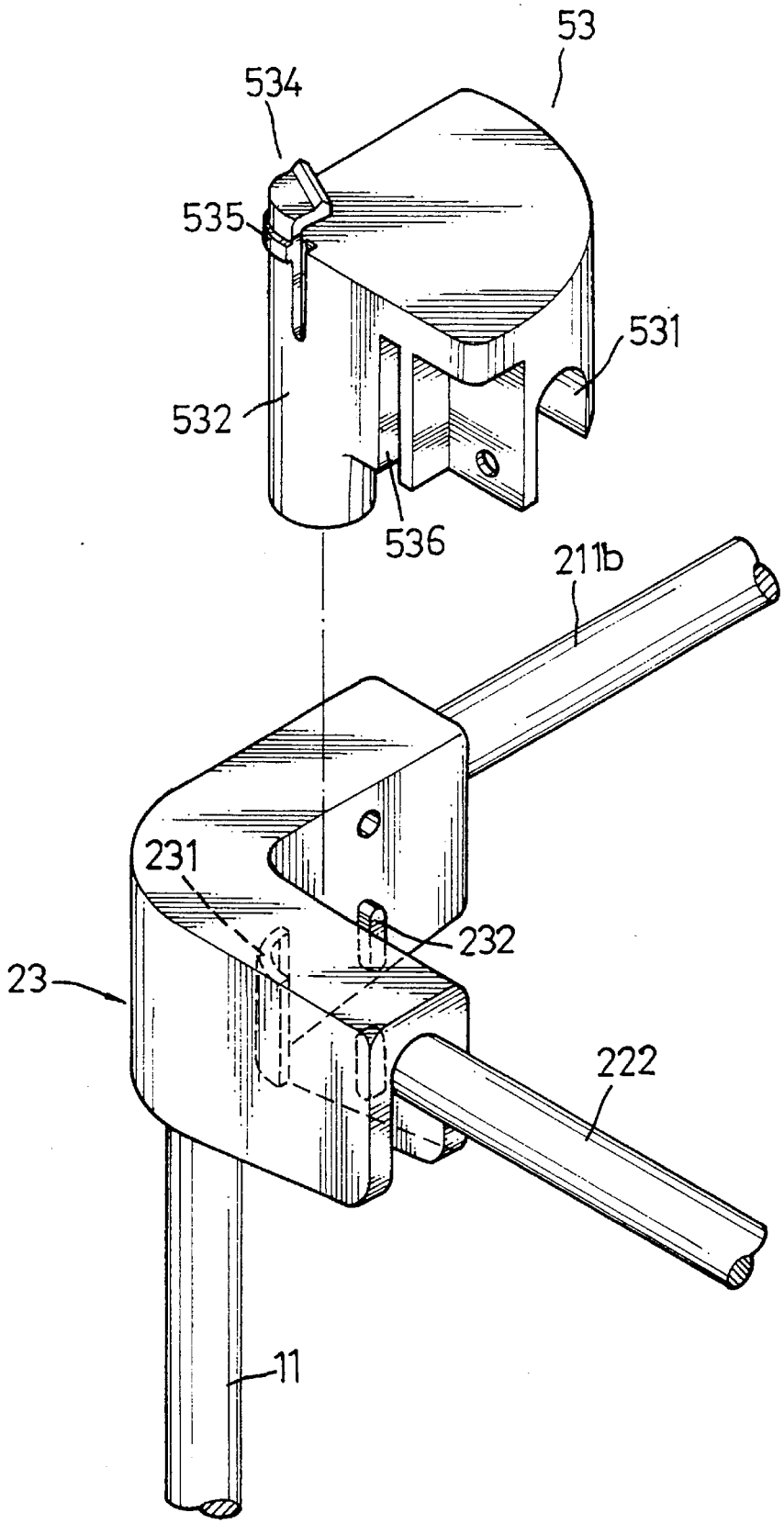
FIG. 8 is a partially exploded view of the foldable playyard showing a corner bracket and a corresponding corner bearer of this invention.

FIG. 8 is a partial exploded view of the foldable playyard showing a corner bracket and a corresponding corner bearer of this invention. As described above, referring again to FIG. 1, an inner playyard frame assembly 50 is combined with the outer playyard frame assembly 10 for height adjustment. The inner playyard frame assembly 50 comprises a second essentially rectangular upper support composed of four pairs of hingedly coupled rail sections 52. Each pair of hingedly coupled rail sections 52 are connected by a hinge 54. Each pair of hingedly coupled rail sections 52 is further pivotably connected to a respective corner bearer 53 (FIG. 8) provided at four corners of the second upper support, each of the corner bearers 53 are releasably gripped to a corresponding corner bracket 23; and four vertical short rails 533 with a height approximately equal to half the height of the vertical rails 11 of the outer playyard frame assembly 10, each rail 533 engaged beneath a corresponding corner bearer 53. As shown in FIG. 8, each of the corner brackets 23 of the first upper support 20 of the outer playyard frame assembly 10 defines a recess 231 longitudinally along the inside surface and has two tenons 232 formed at proper positions of both sides of the recess 231. Each of the corner bearers 53 corresponding to the corner brackets 23 defines two slots 536 for corresponding to and gripping the tenons 232 of the corner bracket 23 and horizontally defines two channels 531 perpendicular to each other at the bottom thereof for engaging with a corresponding pair of rail sections 52. An arcuate block 535 is formed at a corner of the corner bearer 53 for releasably extending into the recess 231 of the corner bracket 23 by a toggle piece 534 disposed above the arcuate block. An ascending pipe 532 is longitudinally and integrally formed at a corner and beneath the arcuate block 535 of the corner bearer 53 for engaging with a corresponding vertical short rail 533.

Figure 9:
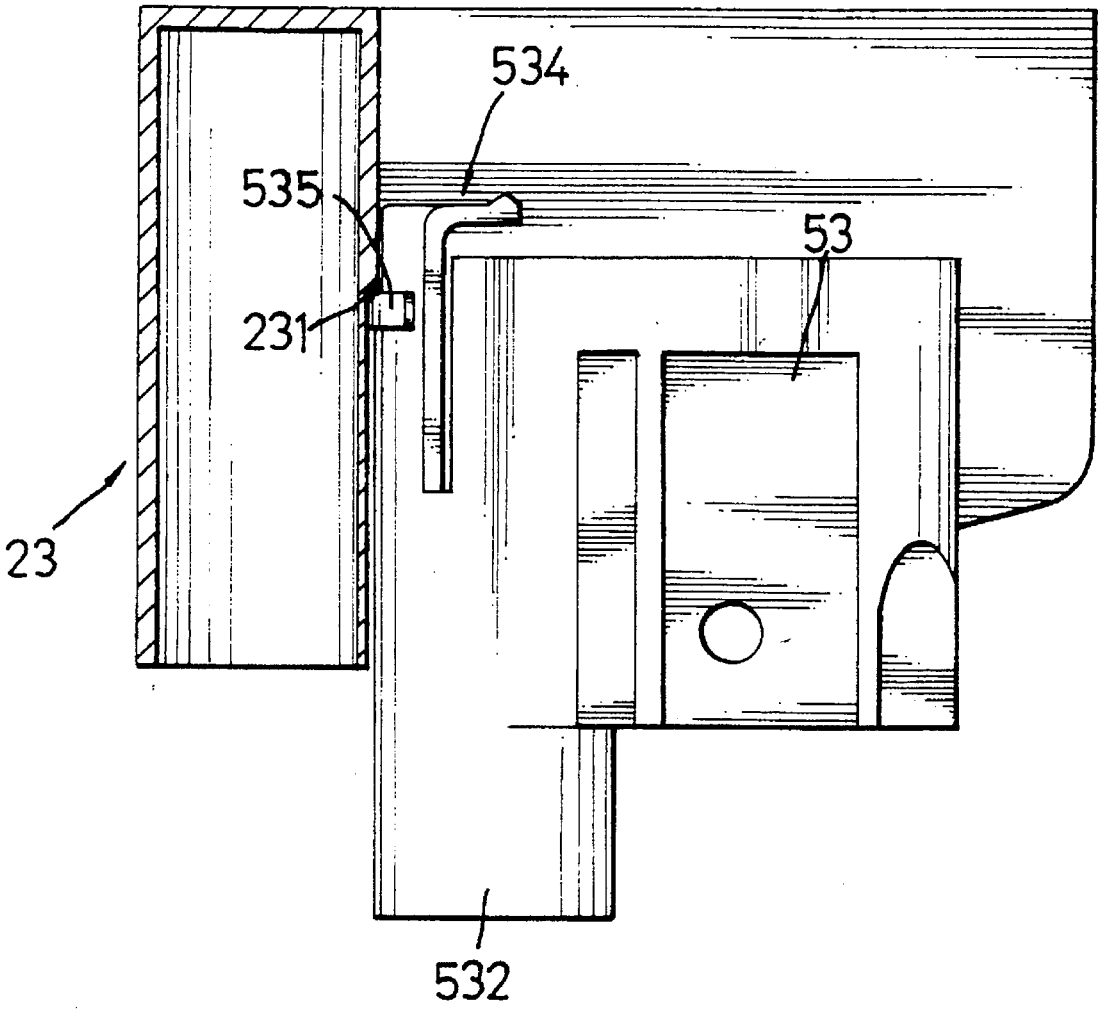
FIG. 9 is a partial cross-sectional view of the foldable playyard showing a combination of the corner bracket and the corresponding corner bearer of FIG. 8.

The combination of the outer and inner playyard frame assembly 10 and 50 will be clearly understood by referring to FIG. 9. When the arcuate block 535 is releasably extending into the recess 231 of the corner bracket 23 by means of the flexible toggle piece 534, the slots 536 are forced to receive the tenons 232 of the corner bracket 23 so as to form a stably located inner frame assembly. The inner playyard frame assembly 50 is designed for use for a young infant. As the child grows up, the inner frame assembly 50 can be disassembled for use from the outer playyard frame assembly 10 by turning the toggle piece 534 and relieving the arcuate block 535 from the recess 231 in order to adjust the height of the playyard.

Figure 10:
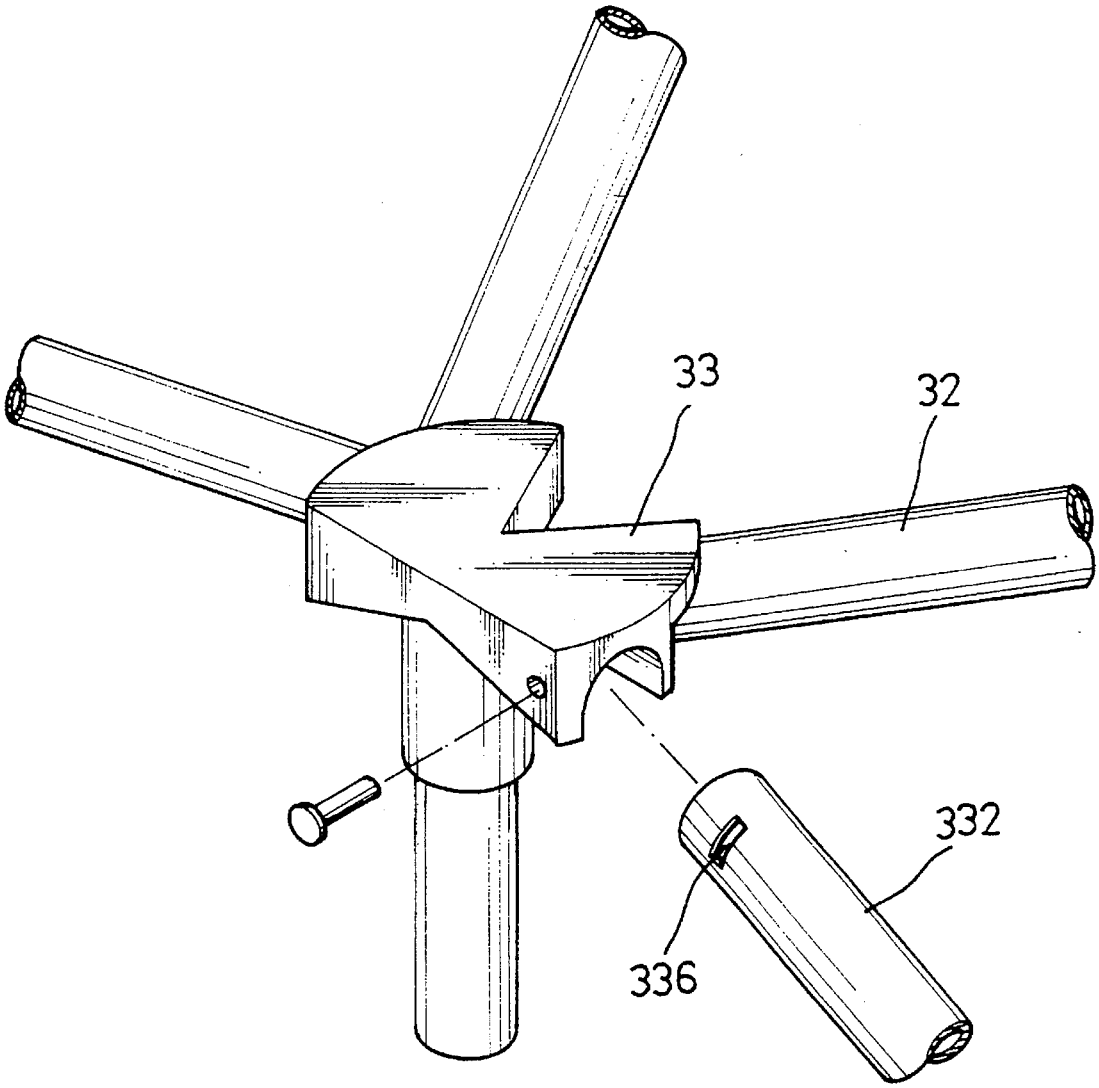
FIG. 10 is a partially exploded view of a lower support in accordance with the present invention, showing a tilting rail section engaging with the hinge.

FIG. 10 is a partial perspective view of a lower support in accordance with the present invention, showing a tilting rail section engaging with the hinge. By further reference to FIG. 2, it can be seen that the curved L-shaped rail sections 332 of the lower support of the outer playyard each has a slot 336 formed at one end thereof for threaded and pivotable engagement to the hinge for a foldable use.

Figure 11:
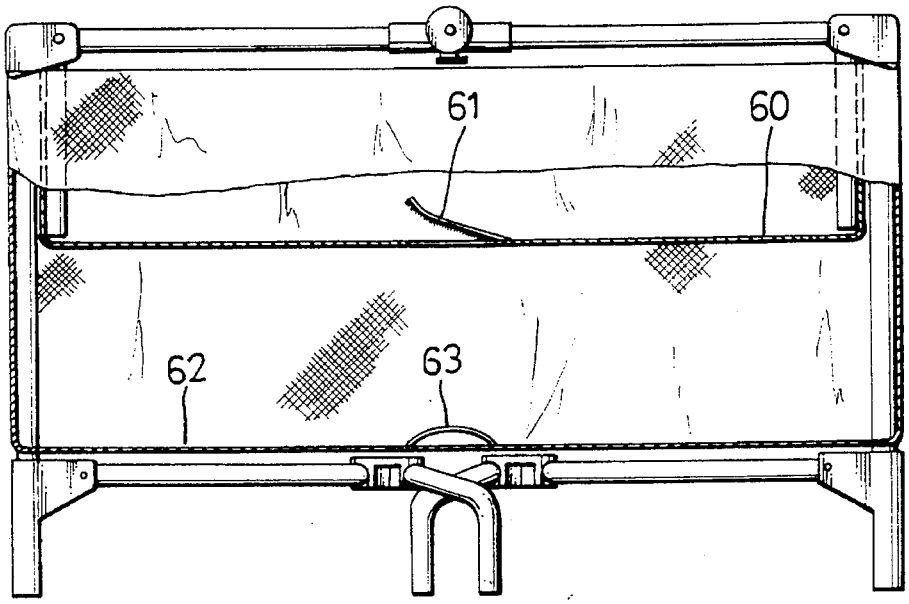
FIG. 11 is a front view of the foldable playyard in accordance with the present invention.
Figure 12:
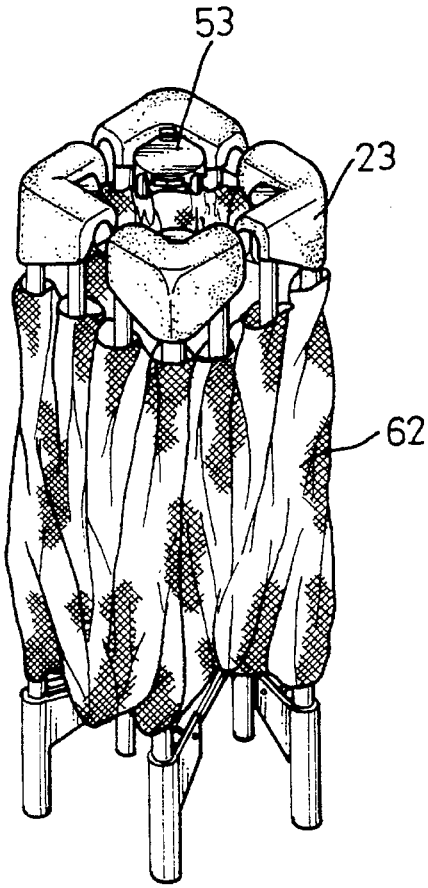
FIG. 12 is a perspective view of the foldable playyard in accordance with the present invention, showing the playyard being folded.

Referring to FIG. 11, which is a front view of the foldable playyard in accordance with this invention, the outer and inner playyard frame assemblies 10 and 50 are both disposed in cloth covers 62 and 60. A handle 63 is stichedly attached on the cloth cover of outer frame assembly 10 at a center and a piece of cloth cover 61 respective to the handle 63 is disposed on the cloth of inner frame 60. When folding the outer and inner playyard 10 and 50 simultaneously, the user can lift the cloth cover 61 and raise the handle upwardly thereby to form a structure as shown in FIG. 12. This provides a readily-foldable operation without disassembling the inner playyard frame assembly 50 prior to being folded and provides a smaller volume for storage after use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foldable playyard comprising:

an outer playyard frame assembly comprising:

a first essentially rectangular upper support composed of four pairs of rail sections each centrally coupled by a switch unit, each pair of rail sections being pivotably connected to a respective corner bracket provided at four corners of the upper support;

four vertical rails each fixedly connected to a corresponding corner bracket at an upper end; and a lower support connected with the four vertical rails at a lower end of the vertical rails; and an inner playyard comprising:

a second essentially rectangular upper support composed of four pairs of hingedly coupled rail sections with each pair further pivotably connected to a respective corner bearer provided at four corners of the second upper support, each of said corner bearers releasably receiving a corresponding corner bracket; and four vertical short rails each integrally formed beneath a corresponding corner bearer.

2. A playyard as claimed in claim 1, wherein the lower support of the outer playyard comprises:

four legs each for receiving a corresponding vertical rail, four tilting rails sections each pivotably coupled to one of the legs at one end thereof, two pairs of curved L-shaped rail sections, each respectively coupled with the other ends of two adjacent tilting rails by a hinge and pivotably attached to each other at a different end; and two posts each disposed under one of the hinges and supporting the corresponding hinge to thereby form a stable lower support structure.

3. A playyard as claimed in claim 2 wherein the curved L-shaped rail sections of the lower portion of the outer playyard are threadedly and pivotably engaged to the hinge for a foldable use.

4. A playyard as claimed in claim 1, wherein said switch unit of the upper support comprises:

a first member having a first tube integrally extending from a first eccentric strap having an opening for connection with one of each pair of the rail sections, defining a convex edge around the eccentric strap and a through-hole at a center for a screw to threadedly extend therethrough;

a second member having a second tube integrally extending from an eccentric strap for connection with the other of each pair of the rail sections and defining a notch at a periphery proximate to the connection of the tube to the eccentric strap and a hole at a center thereof for a screw to threadedly extend therethrough;

a third member sandwiched between the first and second members, defining a notch at a top thereof and an elongate hole for a screw to threadedly extend therethrough and forming a block corresponding to the opening of the first member and a press-portion at the bottom thereof; and a spring compressed between the notch of the third member and a periphery formed by the combination of the first and the second members so as to provide a press-key effect.

5. A playyard as claimed in claim 1, wherein each of said corner brackets of the first upper support of the outer playyard defines a recess longitudinally along an inside surface thereof and has two tenons formed at two sides of the recess.

6. A playyard as claimed in claim 5 wherein each of said corner bearers corresponding to the corner brackets defines two slots for corresponding to and gripping the tenons of the corner bracket and horizontally defines two channels perpendicular to each other at the bottom thereof for engaging with a corresponding pair of rail sections, forming an arcuate block releasably received in the recess of the corner bracket at a respective portion to the recess on the corner bearer by a toggle piece disposed at a corner of an upper portion above the arcuate block.

* * * * *